US005260919A

United States Patent [19]

Tsai

[11] Patent Number: 5,260,919

[45] Date of Patent: Nov. 9, 1993

[54] ELECTRIC TIMER WITH A PROJECTOR

[76] Inventor: Ching-Shyn Tsai, 108, Lane South 2, Nan-Yea Road, Kaohsiung, Taiwan

[21] Appl. No.: 880,023

[22] Filed: May 8, 1992

[51] Int. Cl.[5] ..... G04B 19/00

[52] U.S. Cl. ..... 368/223; 368/227

[58] Field of Search ..... 368/223-239, 368/11, 12

[56] References Cited

U.S. PATENT DOCUMENTS 1,097,310 6/1914 Genter ..... 368/223
1,101,429 5/1914 Genter ..... 368/223
1,137,512 4/1915 Miller ..... 368/223
2,351,238 6/1944 Teuber ..... 368/223

*Primary Examiner*—Bernard Roskoski
*Attorney, Agent, or Firm*—Jacobson, Price, Holman & Stern

[57] ABSTRACT

An electric timer with a projector comprising a common electric timer, a vaccum fluorescent display connected with the timer to display time, and a projector including a speculum and a convex lens, the speculum reflecting the time displayed in the vaccum fluorescent display, the convex lens magnifying and projecting the reflected time on a ceiling or a wall to be easily seen.

3 Claims, 4 Drawing Sheets

ELECTRIC TIMER WITH A PROJECTOR

BACKGROUND OF THE INVENTION

A conventional electric timer, as shown in FIG. 5, comprises a transformer A, a rectifier B, a control circuit C and a light emitting diode display D and sometimes an amplifier E and a loudspeaker F are additionally included to give out sounds or music to function as an alarm clock. Some electric timers are combined with a radio receiver to turn it on at a preset time to wake up a user.

This invention has been devised to offer an electric timer including a projector to project time displayed on a vaccum fluorescent display on a proper flat surface to be easily seen by a user so that he/she may know the time when he/she wakes up in sleeping.

SUMMARY OF THE INVENTION

The electric timer with a projector in accordance with the present invention comprises a common electric timer connected with a vaccum fluorescent display and a projector including a speculum and a convex lens so that the time displayed on the time indicator may be reflected by the speculum and magnified and projected by the convex lens on a proper flat surface such as a ceiling or a wall to be seen clearly by a user, especially lying on a bed to sleep.

BRIEF DESCRIPTION OF DRAWINGS

This invention will now be described in detail with reference to accompanying drawings wherein.

DETAILED DESCRIPTION OF THE INVENTION

Figure 1:
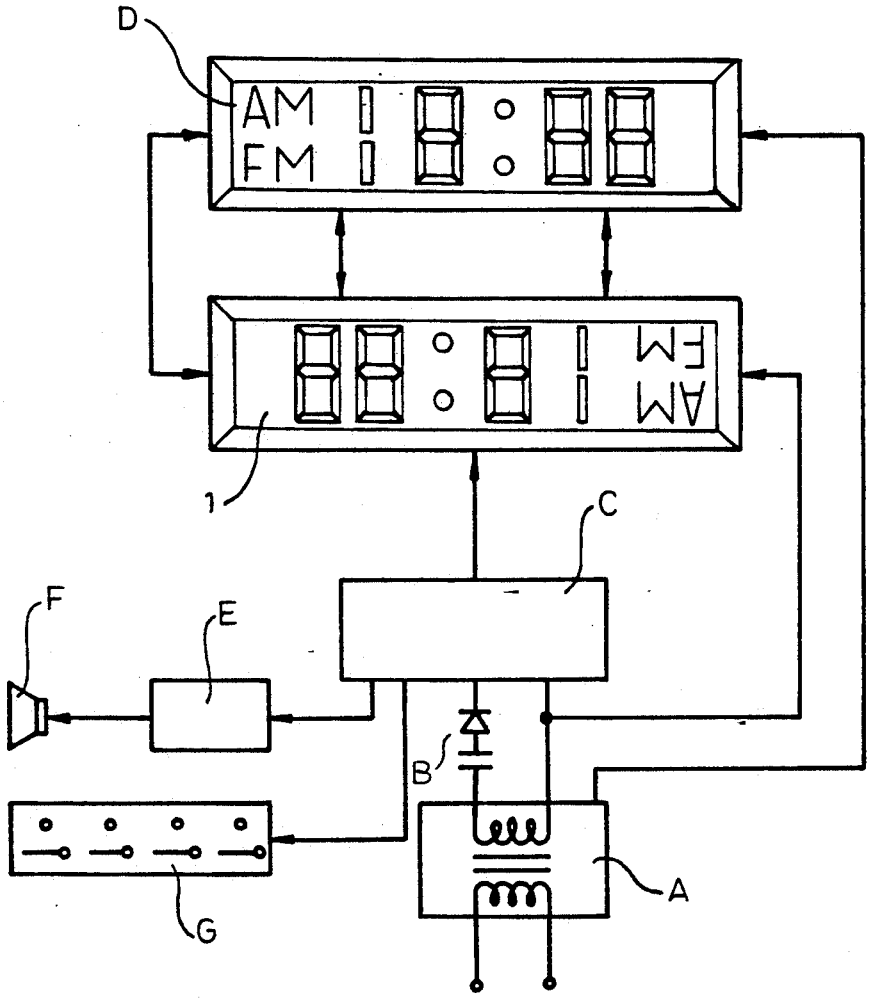
FIG. 1 is a block diagram of a circuit of an electric timer with a projector in the present invention.
Figure 2:
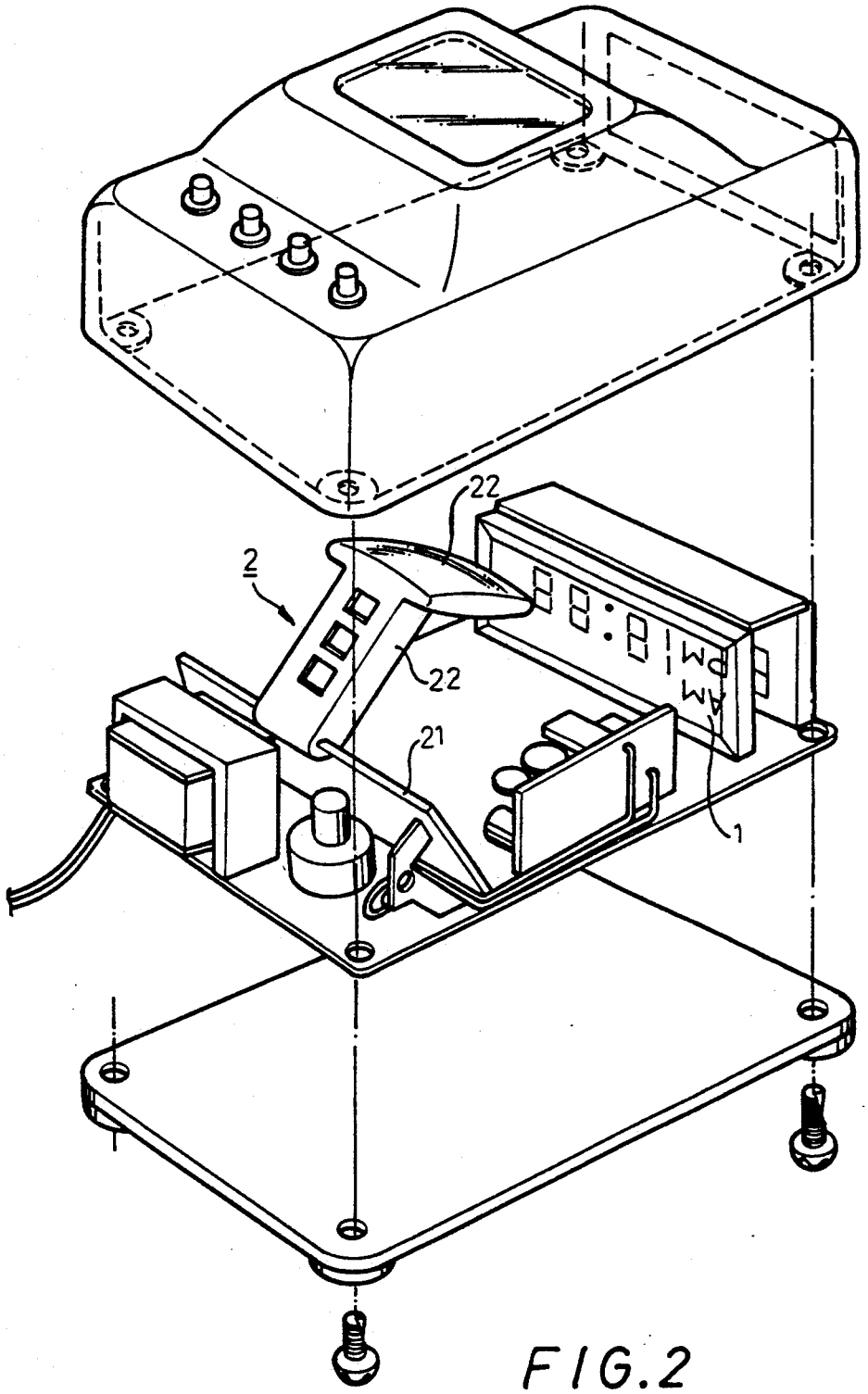
FIG. 2 is an exploded perspective view of the electric timer with a projector in the present invention.
Figure 3:
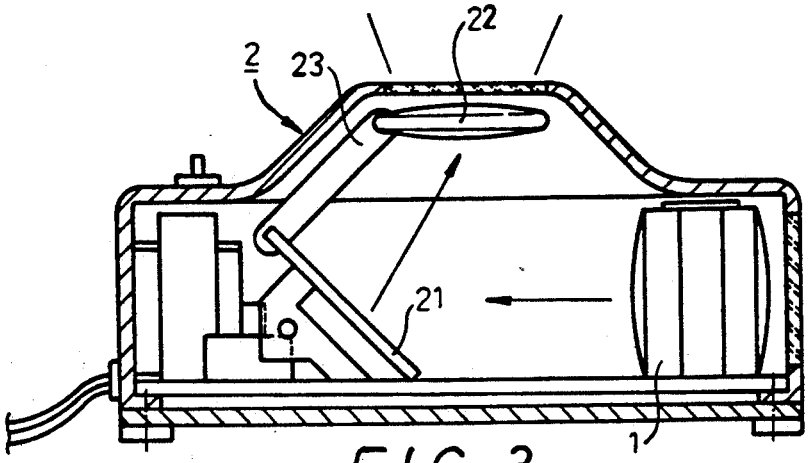
FIG. 3 is a cross-sectional view of the electric timer with a projector in the present invention.
Figure 4:
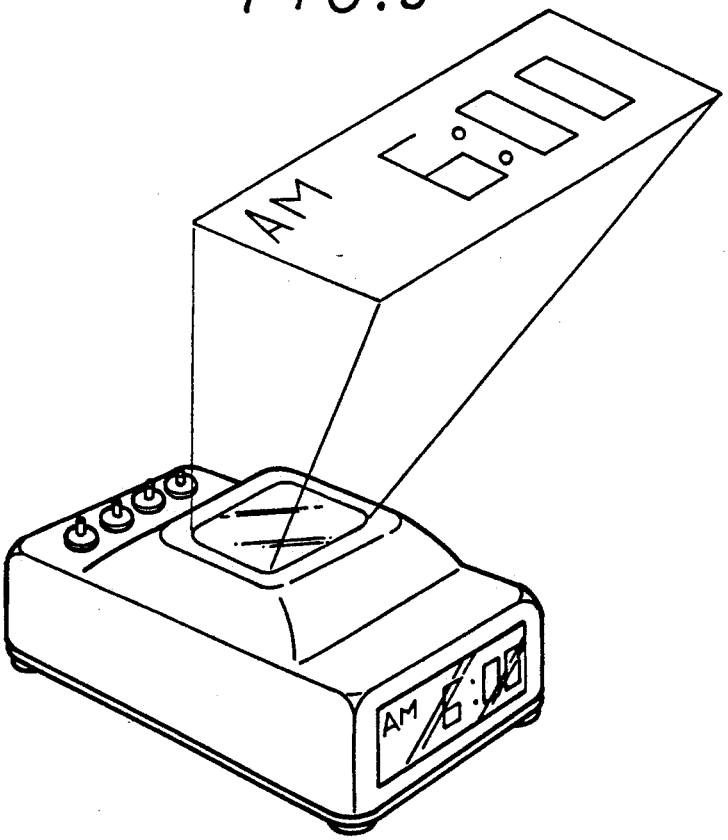
FIG. 4 is a perspective view of the electric timer with a projector in the present invention.
Figure 5:
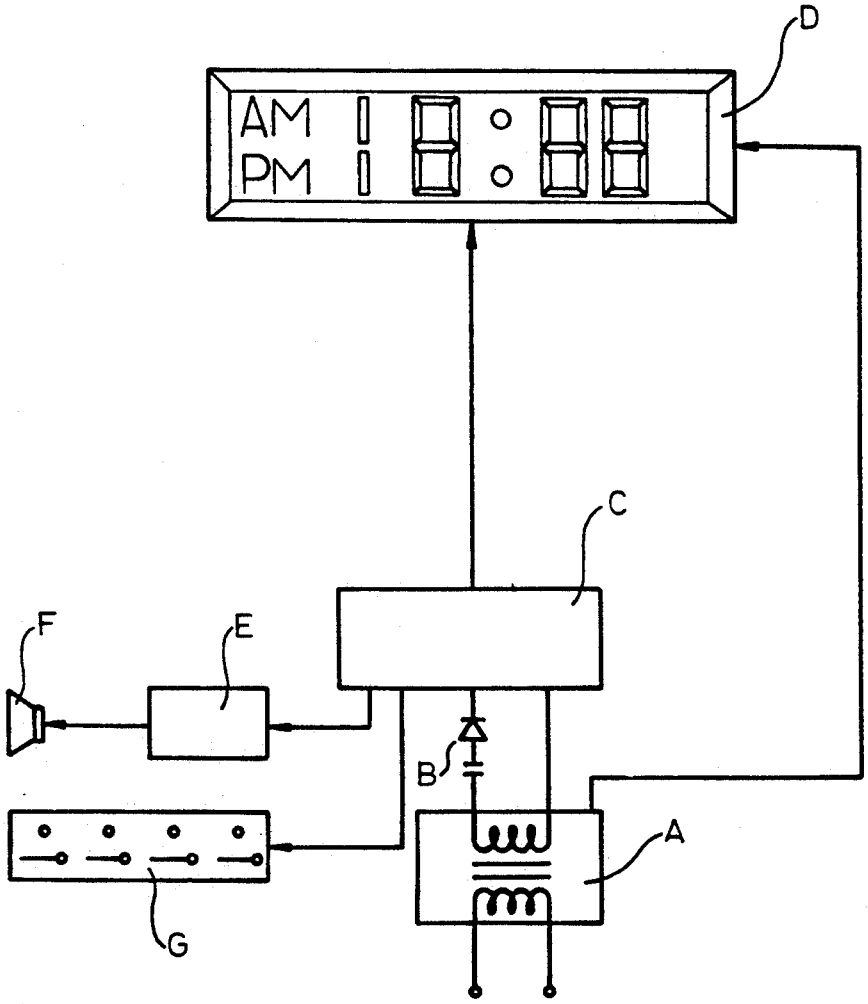
(PRIOR ART) FIG. 5
FIG. 5 is a block diagram of a circuit of a conventional electric timer.

An electric timer with a projector in accordance with the present invention, as shown in FIGS. 2 and 4, comprises a common electric timer, a vaccum fluorescent display 1 electrically connected with the timer for displaying time in a reverse manner and a projector including a speculum 21 and a convex lens 22 and a connecting arm 23 holding both the speculum 21 and the convex lens firmly in a proper angle to each other. The time displayed in the vaccum fluorescent display 1 is to be reflected by the speculum 21 and then the reflected time time is magnified and projected by the convex lens 22 on a ceiling or a wall.

The speculum 21 is set on a base plate, inclined in a proper angle so as to reflect the time displayed in the vaccum fluorescent display 1, and the reflected light may pass through the convex lens 22, which then magnifies and projects the reflected light on a ceiling or a wall so that a user may see the magnified time on the ceiling or the wall with ease.

As the time of the electric timer is projected very large on a ceiling or a wall, a user lying in bed to sleep does not need to look at the time in very small-sized figure displayed on the timer, but can easily check the time by looking at the time projected largely on the ceiling or the wall.

What is claimed is:

1. A digital electric clock with display projecting function, the clock comprising:
   - an electric timing unit;
   - a fluorescent digital display panel for providing an illuminated digital time display; and
   - a projector;
   - said fluorescent digital display panel being positioned to show time for projection by said projector;
   - said projector including a speculum and a convex lens held firmly by a connecting arm;
   - said speculum positioned in a proper inclined angle to reflect an image of the time displayed on said fluorescent digital display panel and to transmit the reflected image to said convex lens positioned in a proper angle in relation to said speculum;
   - said convex lens receiving the reflected image, and magnifying and projecting the reflected image on a ceiling or a wall.

2. The digital electric clock as claimed in claim 1, wherein said fluorescent digital display panel is positioned to display time in a normal manner, and said convex lens projecting a normal image through double reflection.

3. The digital electric clock as claimed in claim 1, wherein said digital display panel is positioned to display time in a reverse manner so that an image of the display time is reflected by the speculum and magnified by the convex lens to provide a projected normal image of the display time.

* * * * *